US009114662B2

(12) United States Patent
Orem et al.

(10) Patent No.: US 9,114,662 B2
(45) Date of Patent: Aug. 25, 2015

(54) INK-DELIVERY SYSTEMS

(71) Applicant: Crayola LLC, Easton, PA (US)

(72) Inventors: Christopher P. Orem, Easton, PA (US); David A. Cziraky, Bethlehem, PA (US); Wolfgang Witz, Wake Forest, NC (US)

(73) Assignee: Crayola, LLC, Easton, PA (US)

( * ) Notice: Subject to any disclaimer, the term of this patent is extended or adjusted under 35 U.S.C. 154(b) by 140 days.

(21) Appl. No.: 13/937,570

(22) Filed: Jul. 9, 2013

(65) Prior Publication Data

US 2013/0294811 A1 Nov. 7, 2013

Related U.S. Application Data

(62) Division of application No. 12/839,623, filed on Jul. 20, 2010, now Pat. No. 8,485,749.

(60) Provisional application No. 61/226,922, filed on Jul. 20, 2009.

(51) Int. Cl.

| | |
|---|---|
| ***B43K 5/00*** | (2006.01) |
| ***B43K 5/18*** | (2006.01) |
| ***B43K 1/12*** | (2006.01) |
| ***B43K 8/00*** | (2006.01) |
| ***B43K 8/02*** | (2006.01) |
| ***B43K 8/03*** | (2006.01) |
| ***B43K 8/04*** | (2006.01) |
| ***B43K 23/04*** | (2006.01) |
| ***B41J 2/175*** | (2006.01) |

(52) U.S. Cl.

CPC ..... *B43K 5/1818* (2013.01); *B41J 2/17596* (2013.01); *B43K 1/12* (2013.01); *B43K 5/1827* (2013.01); *B43K 5/1836* (2013.01); *B43K 8/003* (2013.01); *B43K 8/02* (2013.01); *B43K 8/03* (2013.01); *B43K 8/04* (2013.01); *B43K 23/04* (2013.01)

(58) Field of Classification Search

CPC ... B43K 5/1818; B43K 5/1827; B43K 5/1836
USPC ..... 401/205, 206, 270, 273, 274
See application file for complete search history.

(56) References Cited

U.S. PATENT DOCUMENTS

| | | | |
|---|---|---|---|
| 3,203,026 | A | 8/1965 | Schwartzman |
| 3,468,611 | A | 9/1969 | Ward |

(Continued)

OTHER PUBLICATIONS

Office Action dated Apr. 9, 2015 in U.S. Appl. No. 13/917,119, 7 pages.

*Primary Examiner* — Jennifer C Chiang
(74) *Attorney, Agent, or Firm* — Shook, Hardy & Bacon LLP

(57) ABSTRACT

Ink delivery systems to provide ink from a reservoir to an applicator pad for marking a surface. Ink is stored in a reservoir within a marker body. A valve system controls the flow of ink to the applicator pad to prevent puddling of ink on the marking surface. The reservoir is a hollow body with free flowing ink or may contain a fiber reservoir at least partially saturated with ink. The reservoir may also contain capillary channels and ribs to aid in transporting ink to the valve system. The valve system includes a plug and a spring to bias the plug in a closed position. The plug includes at least one contact surface to contact a housing, and thereby control the flow of ink from the reservoir to the applicator pad. The spring may be a coil spring or a compressible foam-like spring.

7 Claims, 6 Drawing Sheets

(56) References Cited

U.S. PATENT DOCUMENTS

| | | | | |
|---|---|---|---|---|
| 3,481,678 | A | 12/1969 | Schwartzman | |
| 3,570,396 | A | 3/1971 | Schwartzman | |
| 4,588,319 | A * | 5/1986 | Niemeyer | 401/205 |
| 4,652,163 | A | 3/1987 | Karliner et al. | |
| 4,929,969 | A | 5/1990 | Morris | |
| 5,035,524 | A | 7/1991 | Sakurai | |
| 5,411,345 | A | 5/1995 | Ueji et al. | |
| 5,678,940 | A * | 10/1997 | Moeck | 401/203 |
| 5,899,624 | A | 5/1999 | Thompson | |
| 5,967,688 | A | 10/1999 | Hu et al. | |
| 6,086,279 | A | 7/2000 | Yen | |
| 7,086,799 | B1 | 8/2006 | Pappageorge et al. | |
| 7,182,541 | B1 | 2/2007 | Ziniti et al. | |
| 7,344,328 | B2 | 3/2008 | McAuley | |
| 7,931,417 | B2 | 4/2011 | Yamamoto et al. | |
| 2003/0194260 | A1 | 10/2003 | Ward | |
| 2007/0217861 | A1 | 9/2007 | Lange et al. | |

* cited by examiner

INK-DELIVERY SYSTEMS

CROSS-REFERENCE TO RELATED APPLICATIONS

This application is a divisional of U.S. Non Provisional patent application Ser. No. 12/839,623 filed Jul. 20, 2010, entitled "Ink Delivery Systems," which claims priority to U.S. Provisional Patent Application No. 61/226,922 filed Jul. 20, 2009, which are both hereby incorporated by reference in their entirety. Divisional U.S. application Ser. No. 13/917,119, filed Jun. 13, 2013, is also a divisional of U.S. Non Provisional patent application Ser. No. 12/839,623, and is hereby incorporated by reference in its entirety.

SUMMARY

Embodiments of the invention generally relate to ink delivery systems for marking devices. The ink delivery systems include a reservoir of ink housed within an ornamental body. The ink is transferred from the ink reservoir to an applicator pad via a valve system. The valve system works to control the flow of ink from the reservoir to the applicator pad in order to avoid oversaturation of the applicator pad with ink and thus pooling or puddling of ink on a marking surface. The valve systems comprise a plug within a housing that is urged to a closed position by a spring. In use, a force is applied to the plug causing the plug to move from a closed position into the marker body and allow ink to flow around the plug to the applicator pad. The ink is transferred from the applicator pad to the marking surface.

This Summary was provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

BRIEF DESCRIPTION OF THE DRAWINGS

Illustrative embodiments of the invention are described in detail below with reference to the attached drawing figures, wherein.

DETAILED DESCRIPTION

Figure 1:
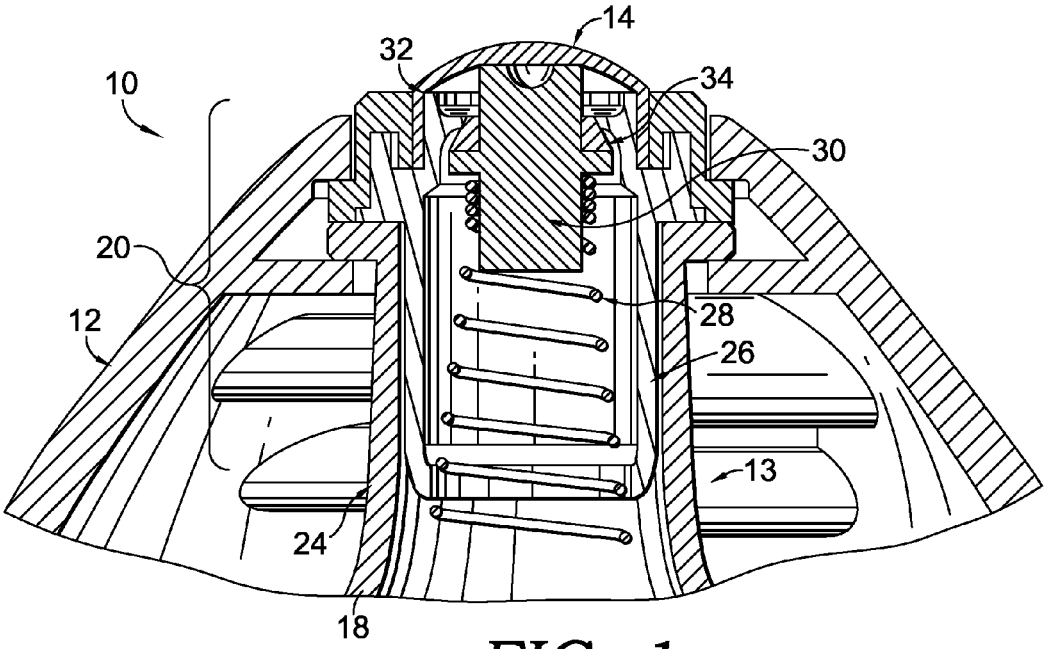
FIG. 1 is a cross-sectional side elevation of a marker in accordance with an embodiment of the invention.

The subject matter of embodiments of the invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although terms such as "step" and/or "block" may be used herein to connote different elements of methods employed, the terms should not be interpreted as implying any particular order among or between various steps herein disclosed unless and except when the order of individual steps is explicitly described.

Embodiments of the invention provide ink delivery systems for a drawing apparatus such as a children's drawing toy. The ink delivery systems deliver ink from a reservoir to an applicator pad via a valve system. In one aspect, an ink-delivery system for a marking device is described. The ink delivery system includes a reservoir body that includes an ink storage portion, a neck portion, and a transition portion between the ink storage portion and the neck portion. The ink storage portion houses a porous pad with an amount of ink stored therein. The transition portion includes a number of capillary channels along an interior surface of the transition portion extending a distance between the ink storage portion and the neck portion. The neck portion houses a valve system for controlling the release of ink to an applicator pad.

In another aspect, an ink-delivery system for a marking device is described. The ink-delivery system includes an ink reservoir that includes a reservoir body and a neck portion, the reservoir body storing an amount of an ink. The ink-delivery system also includes a valve system disposed within the neck portion for controlling the release of the ink to an applicator pad. The valve system includes a housing, a plug, and a spring. The plug is disposed within the housing and has a first end, a second end, and a central member that connects the first end and the second end. The first end is configured to mate with and seal against a first contact surface of the housing. The second end is configured to mate with and seal against a second contact surface of the housing. And the central member has a sufficient length to allow only the first end or the second end to fully mate with and seal against the first contact surface or the second contact surface, respectively, of the housing at one time.

In another aspect, an ink-delivery system for a marking device is described. The ink-delivery system includes a reservoir for storing an ink that includes a body and a neck. The ink-delivery system also includes a porous reservoir that is at least partially wetted with an ink and that is disposed in the body of the reservoir and a valve system disposed in the neck of the reservoir that includes a housing, a plug and a porous spring. The plug is disposed within the housing and is moveable along a shared central axis of the plug and the housing. The plug includes a head and a stem. The head is urged into contact with an end of the housing by the porous spring when in a closed position and the stem extends a distance toward the fiber reservoir.

Figure 2A:
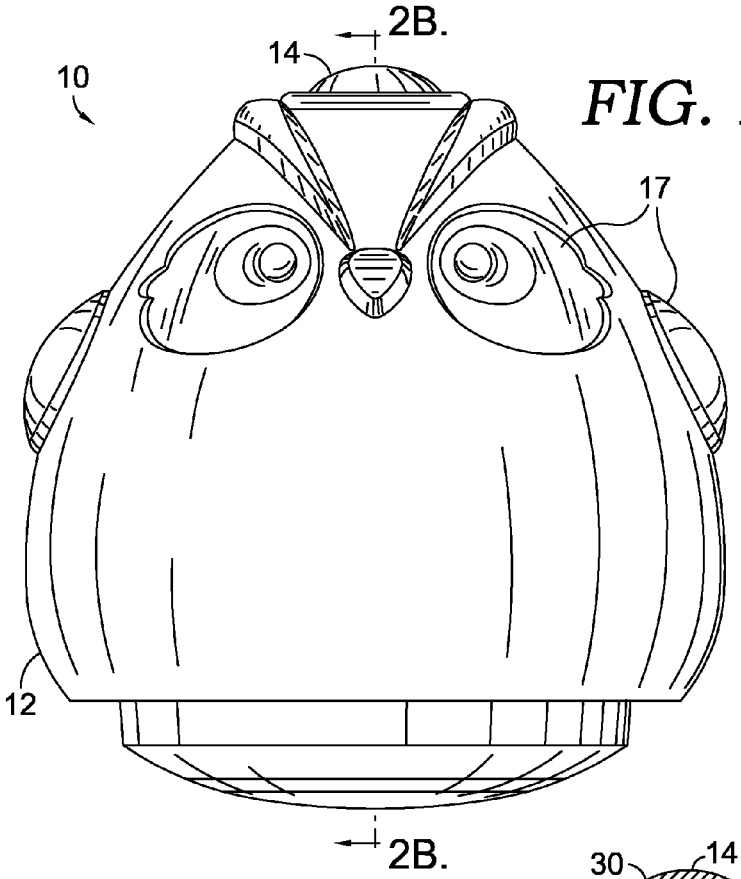
FIG. 2*a* is front side elevation of a marker in accordance with an embodiment of the invention.
Figure 2B:
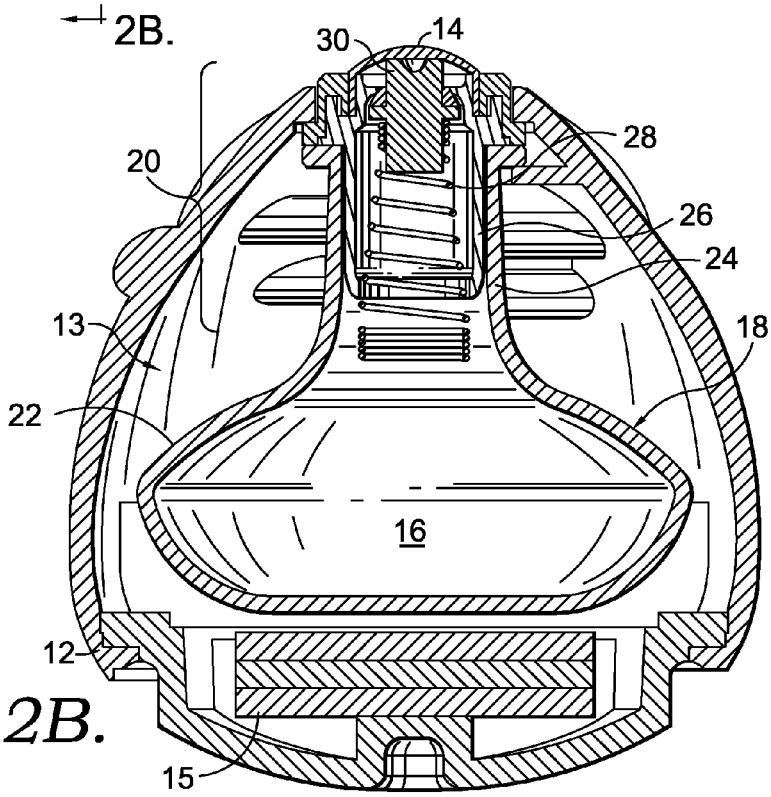
FIG. 2*b* is cross-sectional side elevation of a marker in accordance with an embodiment of the invention.

With reference to FIGS. 1, 2*a*, and 2*b*, a drawing toy (hereinafter "marker 10") is described. The marker 10 comprises a hollow body 12 housing an ink delivery system 13. The body 12 is generally egg shaped such that it is easily graspable by a child, however, the body 12 may take any desired shape. The marker 10 may also include one or more weights 15 secured in a bottom portion of the body 12 to bias the marker 10 to an upright position when placed on a surface. In an embodiment, the body 12 also includes one or more ornamental features 17 thereon to increase the visual appeal of the marker 10 to a user.

An applicator pad 14 of the ink delivery system 13 extends from a top end 19 of the body 12. Ink 16 is supplied to the applicator pad 14 by the ink delivery system 13 to allow a user to use the marker 10 to draw on a surface. The ink delivery system 13 includes a reservoir 18, ink 16, and a spring actuated valve system 20. The reservoir 18 includes a body portion 22 and a neck portion 24. The body portion 22 has sufficient dimensions to house a pool of ink 16 within the marker body 12. The neck portion 24 has sufficient dimensions to house and retain the valve system 20. The ink 16 may be any ink formulation having sufficient properties such as viscosity and surface tension for use in the embodiments described below.

The valve system 20 includes a housing 26, a spring 28, a plug 30, and the applicator pad 14. The housing 26 comprises a generally cylindrical body that is disposed within the neck 24 of the reservoir 18. The spring 28 and the plug 30 are disposed and retained within the applicator housing 26. The spring 28 retains the plug 30 against a top end 32 of the housing 26 to seal the housing 26 and reservoir 18 from the exterior environment. The spring 28 is a compression spring constructed from stainless steel, but may be constructed from other materials such as plastic, nylon, steel, and aluminum, among other materials. The plug 30, spring 28, and applicator housing 26 are aligned coaxially such that the plug 30 translates along their central axis to compress the spring 28 when depressed. One or more sealing components 34, such as O-rings or silicon gaskets may be included on the plug 30 to provide a sufficient seal between the plug 30 and the applicator housing 26. The applicator pad 14 comprises a section of fabric, foam, or combination thereof to receive ink 16 through the valve system 20 and to transfer the ink 16 to a contact surface.

The components of the marker 10 are generally constructed from a plastic material unless described otherwise. The components of the marker 10 may also be constructed from nylon, polyester, or other synthetic materials, or metals, among other materials. Further, various manufacturing methods are available for producing the components of the marker 10 without departing from the scope of the invention.

In use, a user presses the applicator pad 14 against a surface to be drawn on thereby, depressing the plug 30 into the applicator housing 26 and compressing the spring 28. The ink 16 is thereby allowed to flow from the reservoir 18, between the plug 30 and the applicator housing 26 and to wet the applicator pad 14. The ink 16 is transferred from the applicator pad 14 to the surface.

Figure 3:
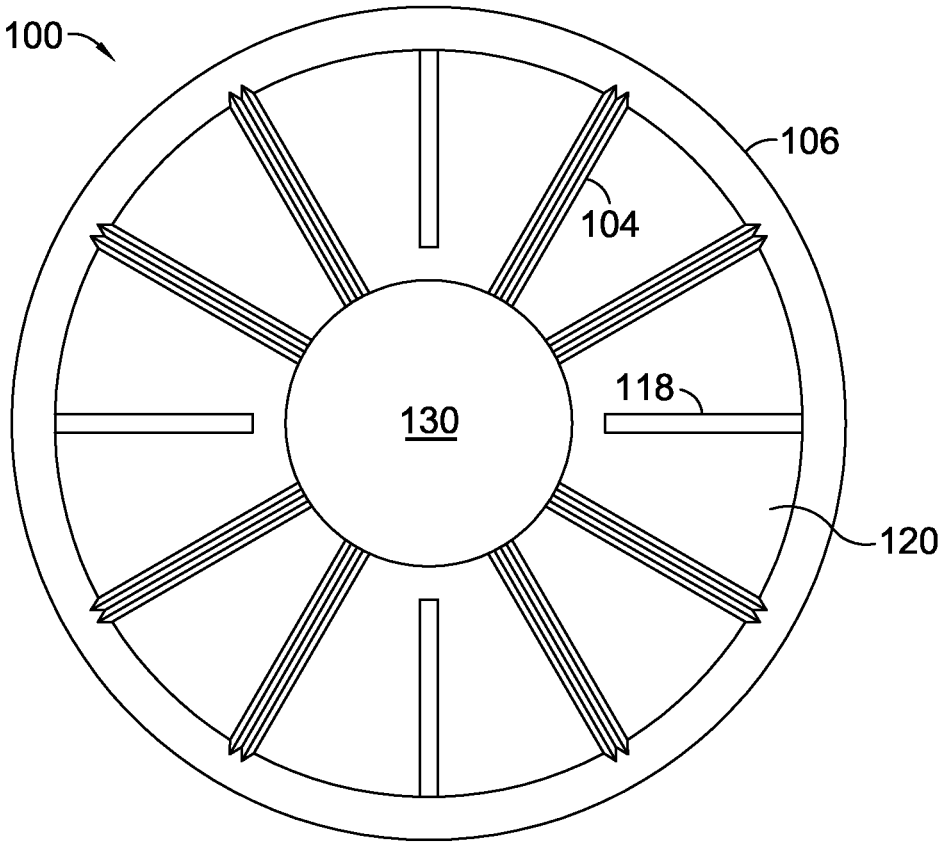
FIG. 3 is schematic illustration depicting capillary channels and ribs on interior surface of a reservoir in accordance with an embodiment of the invention.
Figure 4B:
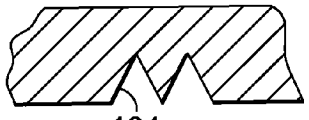
FIG. 4B is a cross-sectional view taken at 4B in FIG. 4A depicting capillary feed channels.
Figure 4A:
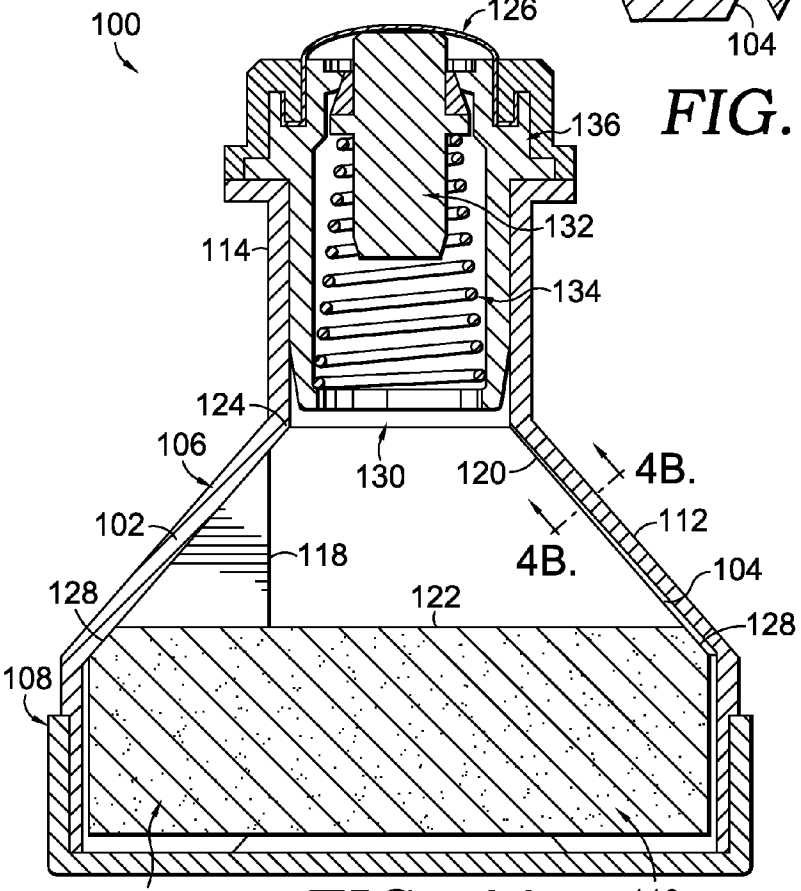
FIG. 4A is a cross-sectional side elevation depicting a reservoir with capillary channels and a rib in accordance with an embodiment of the invention.

With reference now to FIGS. 3, and 4 a marker 100 having an ink delivery system 101 that includes a reservoir 102 with capillary feed channels 104 is described in accordance with and embodiment of the invention. The reservoir 102 includes two component parts, a reservoir body 106 and an end cap 108. The reservoir body 106 has a generally funnel shape with an ink storage portion 110, a transition portion 112, and a neck portion 114. The ink storage portion 110 is generally cylindrical and is configured to accept a foam pad 116 saturated with ink. The foam pad 116 fits within the ink storage portion 110 and contacts the transition portion 112 along a perimeter of the foam pad and is held in position in one direction by the contact. The end cap 108 couples to the reservoir body 106 to enclose the foam pad 116 within the reservoir body 106. Various configurations of the reservoir body 106 and portions thereof are possible without departing from the scope of the invention and are understood as disclosed herein.

The transition portion 112 extends from the generally larger diameter ink storage portion 110 to the generally smaller diameter neck portion 114 in a truncated cone configuration. One or more ribs 118 extend from the interior surface 120 of the transition portion 112 and contact a top surface 122 of the foam pad 116 to aid in retaining the foam pad 116 in position. A plurality of capillary channels 104 is also included on the interior surface 120 of the transition portion 112 extending from the ink storage portion 110 to the neck portion 114. The channels 104 have any desired cross-sectional shape. In an embodiment, the depth of the channels 104 is deepest where they meet the ink storage portion 110 and decreases to generally zero depth at or near a point 124 where the transition portion 112 meets the neck portion 114. The channel 104 depth at its deepest may be from 0.040" to 0.005". The ink delivery system 101 is configured to be housed within a body, such as the body 12 as described above with respect to marker 10 and utilizes a valve system similar to the valve system 20 described above. It is understood, however that any valve system can be employed with the ink delivery system 100.

In use, a user orients the marker 100 such that an applicator pad 126 points generally downward and contacts a marking surface. In such an orientation, ink 16 drains from or seeps out of the foam pad 116 preferentially at contact areas 128 between the foam pad 116 and the transition portion 112 of the reservoir 106. The ink 16 is drawn along the capillary channels 104 by gravity and/or capillary action toward the neck portion 114. Ink 16 pools at a mouth 130 of the neck portion 104 at a rate sufficient to provide adequate supply to the applicator pad 126 without over saturating the applicator pad 126 or causing puddling of ink 16 on the marking surface.

The ink 16 is released from the ink delivery system 101 by downward force on the marker 100 causing an upward force on a plug 132. Thereby, the plug 132 is forced inwardly toward the reservoir 106, compressing a spring 134 and allowing ink 16 to pass between the plug 132 and an applicator housing 136. The ink 16 contacts and is absorbed into the applicator pad 126 from which it can be transferred to the marking surface. When marking is complete the marker 100 is returned to its original orientation and any free ink 16 inside the reservoir returns to the foam pad 116 by gravity. The ribs 118 may also provide a contact surface and transfer surface for transferring the ink 16 from the foam pad 116 to the neck portion 114.

With reference now to FIGS. 5 and 6A-C, a marker 200 having an ink delivery system 201 is described in accordance with an embodiment of the invention. The ink delivery system 201 is housed in a body (not shown) and includes a reservoir 202 and applicator pad 204 similar to that described above with respect to FIGS. 1 and 2.

A valve system 206 disposed within a neck portion 208 of the reservoir 202 includes a housing 210, a spring 212, a plug 214, and an applicator pad 204. The housing 210 is a generally cylindrical structure having an opening at each end and is configure to allow coaxial translational movement of the plug 214 and spring 212. The housing 210 is further configured to provide a first 216 and a second 218 contact surface for the plug 214. The first contact surface 216 is at an upper end 220 of the housing 210 near the applicator pad 204 while the second contact surface 218 is at a lower end 222 of the housing 210 nearest to the ink in the reservoir 202.

Figure 5:
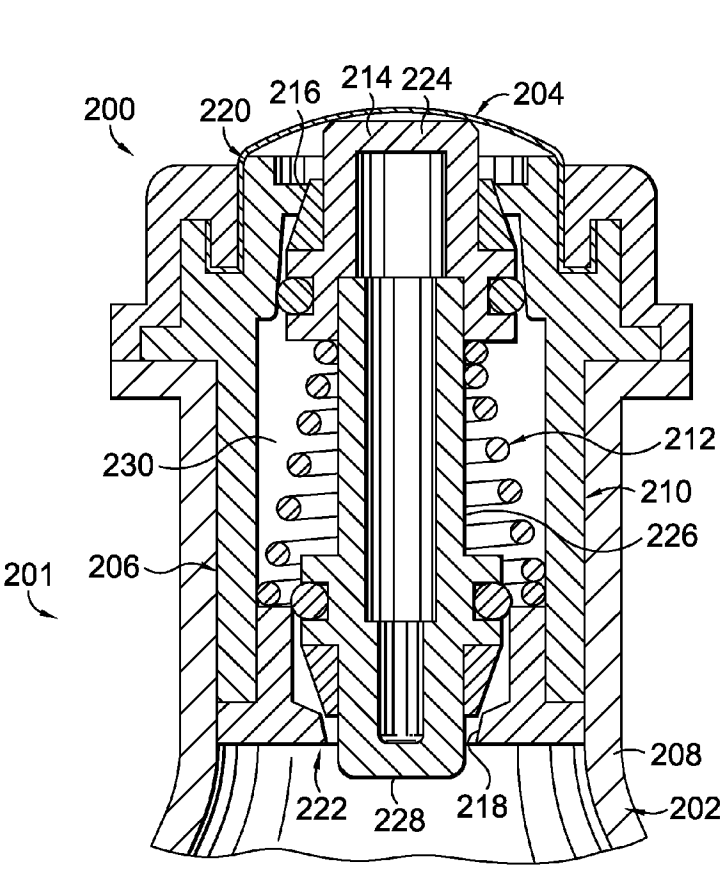
FIG. 5 is a cross-sectional side elevation depicting an ink delivery system with a plug having first and second ends in accordance with an embodiment of the invention.
Figure 6C:
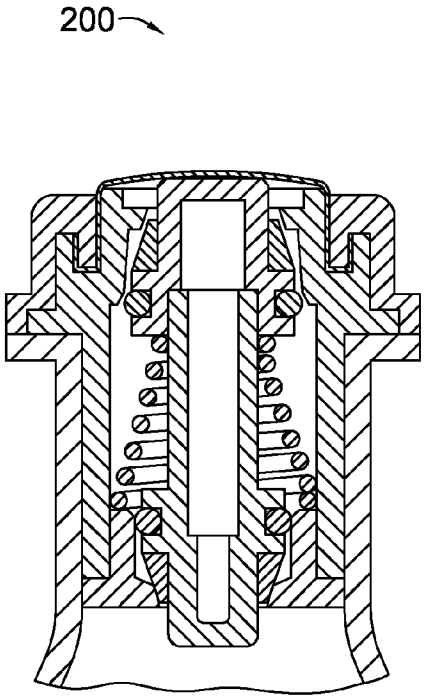
FIGS. 6A-C are a series of three cross-sectional side elevations of an ink delivery system with a plug having first and second ends depicting translational movement of the plug in accordance with an embodiment of the invention.

The plug 214 is disposed within the housing 210 and includes a first end 224, a central member 226, and a second end 228. The first end 224 is configured to mate with the first surface 216 of the housing 210 and to thereby seal the upper end 220 of the housing such that the interior of the housing 210 and reservoir 202 are sealed from the external environment (as depicted in FIGS. 5 and 6A). The second end 228 of the plug 214 is configured to mate with the second surface 218 of the housing 210 and to thereby seal the interior of the reservoir 202 from the external environment (as depicted in FIG. 6C). In an embodiment, an o-ring is disposed around each of the first end 224 and the second end 228; the o-ring acts to form a seal against a surface of the interior of the housing 210 instead of, or in addition to the seal provided between the first and second ends 224, 228 and the first surface and second surface 216, 218, respectively. In an embodiment, the o-rings form a sliding seal with the interior surface of the housing 210.

The central member 226 connects the first and second ends 224, 228 of the plug 214 together and has a length configured to allow only the first end 224 or the second end 228 to fully engage their respective surfaces 216, 218 of the housing 210 at any given time. The length is also such that both ends 224, 228 will at least partially engage their respective ends 220, 222 of the housing 210 at the same time during transition from full engagement of the first end 224 to full engagement of the second end 228.

The spring 212 is disposed around the central member 226 of the plug 214 and urges the plug 214 toward the upper end 220 of the housing 210 such that the first end 216 of the plug 214 and first surface 216 of the housing 210 are in contact and the reservoir 202 is sealed from the external environment when the marker 200 is not in use.

In use, a user orients the marker 200 such that the applicator pad 204 points generally downward and contacts a marking surface. In such an orientation, the ink in the reservoir 202 flows into the housing 210 and fills a void 230 within the housing 210 (as generally depicted in FIG. 6A). Any remaining ink pools above the housing 210 in the reservoir 202.

Figure 6B:
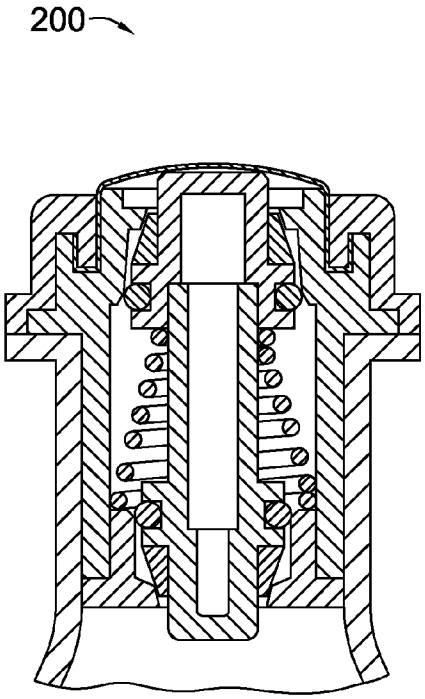
Figure 6A:
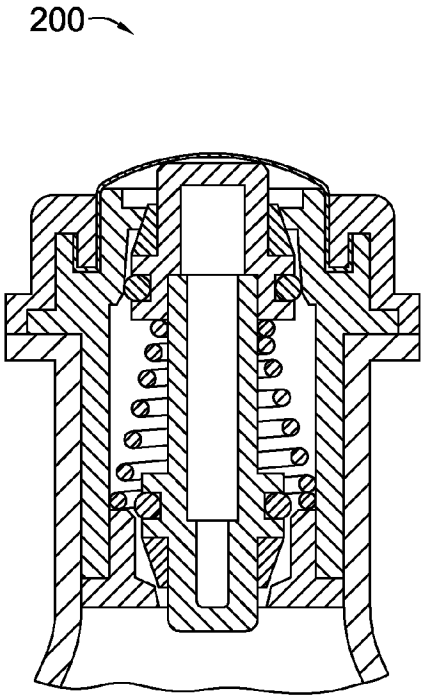

A user applies a downward force on the marker 200 causing the plug 214 to be forced into the housing 210 and to compress the spring 212, as shown in FIG. 6B. As the plug 214 is translated into the housing 210 the first end 224 slides along, but remains in contact with the first surface 216 of the housing 210 while the second end 228 comes into contact the second surface 218 of the housing 210. Thus, the ink within the housing 210 is trapped therein.

As the plug 214 continues to translate into the housing 210 the first end 224 loses contact with the first surface 216 and the second end 228 fully engages the second surface 218, as shown in FIG. 6C. Thereby, the ink trapped within the housing 210 can flow out of the valve system 206 and wet the applicator pad 204, but the ink in the reservoir 202 remains therein and is sealed from the external environment.

As the force is removed, the spring 212 causes the plug 214 to translate in the opposite direction. The housing 210 and reservoir 202 are thus sealed from the external environment. Additional ink is again allowed to flow into the housing 210.

Figure 8:
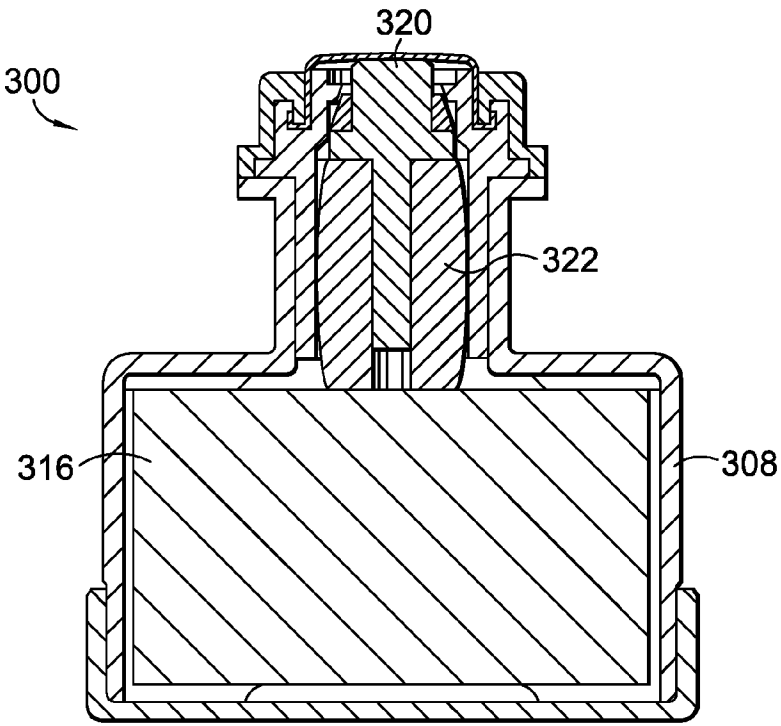
FIG. 8 is a cross-sectional side elevation depicting an ink delivery system having a fiber reservoir and a foam spring in which the plug is depressed causing compression of the foam spring in accordance with an embodiment of the invention.
Figure 7:
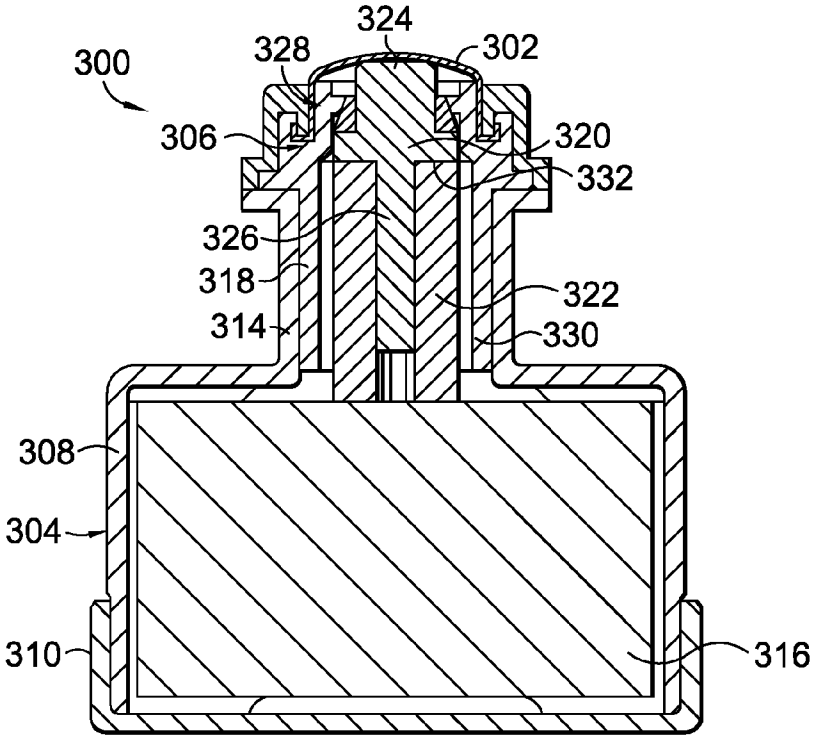
FIG. 7 is a cross-sectional side elevation depicting an ink delivery system having a fiber reservoir and foam spring in accordance with an embodiment of the invention.

Referring now to FIGS. 7 and 8, a marker 300 having an ink delivery system 301 is described in accordance with an embodiment of the invention. The ink delivery system 301 is housed in a body (not shown) and includes an applicator pad 302 similar to that described above with respect to FIGS. 1 and 2. The ink delivery system 301 includes a reservoir 304 and a valve system 306. The reservoir 304 is comprised of a reservoir body 308 and an end cap 310. The reservoir body 308 includes an ink storage portion 312 and a neck portion 314. The ink storage portion 312 is configured to accept and house a fiber reservoir 316 saturated with ink, such as ink 16. The fiber reservoir 316 is configured to fill the interior volume of the ink storage portion 312. The fiber reservoir 316 is comprised of a foam, fibrous material, sponge, or combination thereof and may have variable density to aid in promoting movement of the ink stored therein toward the valve system 306. The end cap 310 couples to the reservoir body 308 to enclose the fiber reservoir 316 within the reservoir body 308. The neck portion 314 is generally smaller in diameter than the ink storage reservoir 312 and is configured to house the valve system 306.

The valve system 306 includes a housing 318, a plug 320, a foam spring 322 and the applicator pad 302. The housing 318 is generally cylindrical and is open at each end. The housing 318 is disposed within the reservoir neck portion 314. The plug 320 has a head 324 and a stem 326 and is disposed within the housing 318 such that the head 324 engages an upper end 328 of the housing 318 to seal the interior of the reservoir 304 from the external environment when in a storage position, as depicted in FIG. 7. The stem 326 extends from the head 324 toward the interior of the reservoir 304 a distance generally less than the length of the housing 318.

The foam spring 322 is disposed around the stem 326 and between the stem 326 and an interior surface 330 of the housing 318. The foam spring 322 is generally cylindrical in shape and extends from a bottom surface 332 of the plug 324 head to the fiber reservoir 316. The contact of the foam spring 322 with the fiber reservoir 316 allows ink to flow from the fiber reservoir 316 into the foam spring 322 by gravity or capillary action, among other mechanisms. The applicator pad 302 is disposed over the plug head 324 and across the upper end 328 of the housing 318.

In use, a user places the applicator pad 302 in contact with a marking surface. A downward force is exerted on the marker 300 causing the plug 320 to be depressed into the housing 318, thereby compressing the foam spring 322. Compression causes the interior volume of the foam spring 322 to be reduced; thereby an amount of ink contained in the foam spring 322 is expressed from the foam spring 322. The ink flows around the depressed plug head 324 and into the applicator pad 302. The ink may then be transferred from the applicator pad 302 to the marking surface. When the force is removed the foam spring 322 biases the plug 320 back to its original storage position and the foam spring 322 is decompressed. The decompression can draw additional ink into the foam spring 322 from the fiber reservoir 316.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

We claim:

1. An ink-delivery system for a marking device comprising:

a reservoir for storing an ink, the reservoir including a body and a neck;

a porous reservoir that is at least partially wetted with an ink and that is disposed in the body of the reservoir;

a valve system disposed in the neck of the reservoir that includes a housing, a plug and a porous spring;

wherein the plug is disposed within the housing and is moveable along a shared central axis of the plug and the housing, the plug including a head and a stem, the head is urged into contact with an end of the housing by the porous spring when in a closed position, and the stem extends a distance toward the fiber reservoir.

2. The ink-delivery system of claim 1, wherein the porous spring is disposed inside the housing in contact with the fiber reservoir at a first end and the head at a second end.

3. The ink-delivery system of claim 1, wherein the foam spring absorbs ink from the fiber reservoir.

4. The ink-delivery system of claim 1, wherein the plug is depressed into the housing to compress the porous spring, the foam spring expresses ink stored therein, and the expressed ink flows around the plug to wet the applicator pad.

5. The ink-delivery system of claim 1, wherein the porous reservoir is composed of one or more of fibers, foams, and sponges.

6. The ink-delivery system of claim 1, wherein the porous spring is composed of one or more of fibers, foam, and sponges.

7. The ink-delivery system of claim 1, wherein the porous reservoir includes a variable density along one or more of its dimensions to promote fluid flow.

* * * * *